US005617600A

United States Patent [19]

Frattini

[11] Patent Number: 5,617,600

[45] Date of Patent: Apr. 8, 1997

[54] SELF-PROPELLED UNDERWATER ELECTROMECHANICAL APPARATUS FOR CLEANING THE BOTTOM AND WALLS OF SWIMMING POOLS

[76] Inventor: Ercole Frattini, Via Mottarone, 16, 21020 Bodio (Varese), Italy

[21] Appl. No.: 353,348

[22] Filed: Dec. 5, 1994

[30] Foreign Application Priority Data

Dec. 3, 1993 [IT] Italy ..... MI93A2566

[51] Int. Cl.[6] ..... E04H 4/16

[52] U.S. Cl. ..... 15/1.7

[58] Field of Search ..... 15/1.7, 49.1; 210/169; 310/87, 88, 45

[56] References Cited

U.S. PATENT DOCUMENTS

| | | | |
|---|---|---|---|
| 2,758,226 | 8/1956 | Fisher | 310/45 |
| 2,761,985 | 9/1956 | Schaefer | 310/45 |
| 2,923,954 | 2/1960 | Babcock . | |
| 3,906,572 | 9/1975 | Winn | 15/1.7 |
| 3,979,788 | 9/1976 | Strausak | 15/1.7 |
| 4,052,950 | 10/1977 | Hirata | 15/1.7 |
| 4,304,022 | 12/1981 | Sommer | 15/1.7 |
| 4,518,437 | 5/1985 | Sommer | 15/1.7 |
| 4,651,039 | 3/1987 | Yamamoto et al. | 310/87 |
| 4,982,125 | 1/1991 | Shirakawa | 310/88 |
| 5,245,723 | 9/1993 | Sommer | 15/1.7 |
| 5,256,207 | 10/1993 | Sommer | 15/1.7 |
| 5,351,355 | 10/1994 | Chiniara | 15/1.7 |

FOREIGN PATENT DOCUMENTS

| | | | |
|---|---|---|---|
| 862957 | 2/1971 | Canada | 15/1.7 |
| 0314259 | 5/1989 | European Pat. Off. . | |
| 314259 | 5/1989 | European Pat. Off. | 15/1.7 |
| 468876 | 1/1992 | European Pat. Off. | 15/1.7 |
| 2685374 | 6/1993 | France | 15/1.7 |
| 1199886 | 7/1970 | United Kingdom . | |

*Primary Examiner*—Tony G. Soohoo
*Attorney, Agent, or Firm*—Young & Thompson

[57] ABSTRACT

Self-propelled underwater electromechanical apparatus for cleaning the bottom and the walls of swimming pools, having an electric motor which operates a propeller turbine for circulating the water and a driving unit for transmitting movement to a roller travel system. The electric motor and the driving unit are made with an open structure in which the swimming-pool water freely circulates. The electric motor is of the brushless type and both the winding of its rotor and that of its stator are embedded in an impermeable resin. The driving unit has a reduction unit with an output shaft operating two roller travel systems mounted on opposite sides of the apparatus. Devices for achieving reversal of movement consisting of a shaft extension oscillating between two different working positions, are arranged between the output shaft and the two travel systems.

20 Claims, 3 Drawing Sheets

SELF-PROPELLED UNDERWATER ELECTROMECHANICAL APPARATUS FOR CLEANING THE BOTTOM AND WALLS OF SWIMMING POOLS

BACKGROUND OF THE INVENTION

1. Field of the Invention

The present invention relates to a self-propelled underwater apparatus, commonly called a cleaning robot, designed to function underwater so as to clean the bottom and walls of swimming pools, in particular a robot which is operated electromechanically.

2. Description of the Related Art

These cleaning robots are normally able to perform two separate functions:

- on the one hand, suck in the swimming-pool water, pass it through a filtering and, where necessary, disinfecting system, and expel it again;
- on the other hand, move along the end wall and, if necessary, along the side walls of the swimming pool, with brush systems which remove the substances deposited on these walls, facilitating suction thereof towards the filtering system.

The mode of operation of these robots may be of the hydraulic or the electric type: the invention relates to the latter type. The electrically operated cleaning devices which are currently available on the market all have at least the following basic technical characteristics:

- at least two electric actuating motors contained inside a watertight chamber housed in the body of the robot and connected to an electric power cable passing in a leakproof manner through a hole in the wall of the chamber. This cable is connected up outside the swimming pool and is long enough to follow the movements of the robot along the whole of the swimming pool itself;
- a turbine for sucking in and delivering the water through the filtering system, which is rotated by a transmission shaft connected to one of said actuating motors, said shaft passing, in turn, in a leakproof manner through a hole in the wall of the motor housing;
- a drive system, of the wheel or belt type, in turn operated by one or two of said actuating motors via an associated transmission shaft and at least one reducer;
- a control system, originally of the electric type and currently preferably of the electronic type, for effecting, with appropriate timing, the forwards and backwards movements of the robot and changes in direction. This system is in turn contained inside the watertight chamber of the motor.

These robots have—as can be easily understood since they constantly function underwater—a relatively complex and hence costly liquid-tight structure; in addition, the use of an electronic control board also implies the use of relays and electromagnetic connections which, by their very nature, are costly and delicate; the watertight chamber requires, moreover, the provision of a heat exchanger in order to dispose of the heat generated by the electric and electronic systems contained therein; finally, this watertight chamber, despite all the precautions, is often subject to water-infiltration problems—precisely on account of the environment in which the robot is intended to operate and owing to the fact that the seal between moving parts (fixed housing and rotating shaft) is ensured by a gasket subject to rapid wear—resulting in problems in particular for the electrical parts.

SUMMARY OF THE INVENTION

The aim of the present invention, therefore, is to provide an underwater cleaning robot, of the electrically operated type, which is able to overcome the aforementioned drawbacks, in particular via an extremely simple structure devoid of electronic control means and substantially unaffected by the action of the water in which it is immersed. This result is achieved essentially by a robot comprising a single electric motor which operates, on the one hand, a propeller turbine for circulating the water and, on the other hand, a drive for transmitting movement to a roller travel system, and in that at least said electric motor and/or said drive are made with an open structure inside which the swimming-pool water freely circulates.

Preferably said electric motor has both the electric winding of its rotor and that of its stator embedded in an impermeable thermosetting resin, a water passage also being formed in the air gap between stator and rotor.

Preferably, moreover, the drive comprises a reducer unit with an output shaft which operates two roller travel systems mounted on opposite sides of the body of the apparatus, movement reversal means being located between said output shaft and said two travel systems.

More particularly, said the output shaft is formed by a substantially rigid central section, to which are hingeably joined two extension sections which are locked in rotation with the central shaft, but the ends of which are able to oscillate between two different working positions, each extension shaft having mounted on its end at least one gear, forming the movement reversal means so as to engage with a forward travel pinion or alternatively with a reverse travel crown gear, in one or other of the two oscillating positions respectively.

BRIEF DESCRIPTION OF THE DRAWINGS

Further characteristic features and advantages of the apparatus according to the invention will emerge, however, more clearly from the detailed description which follows of a preferred embodiment thereof, provided solely by way of example and illustrated in the accompanying drawings in which.

FIG. *5a* is a diagram of one of the cams which controls the forward or reverse travel or rotational condition of the robot, in a condition wherein the spring-biased bearing is in contact with zone A or B.

FIG. *5b* is a diagram showing, superimposed, the profiles of the pair of cams which control the forward or reverse travel or rotational condition of the robot, without the use of any electric or electronic timing or gear changing system.

Figure 5A:
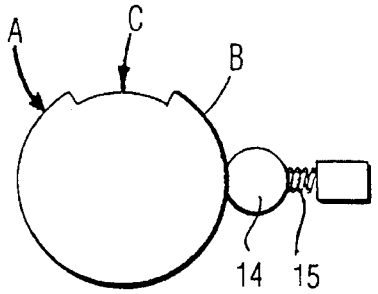
Figure 5B:
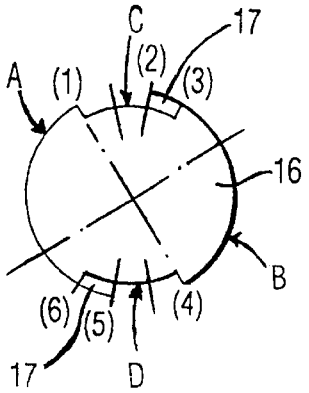
Figure 5C:
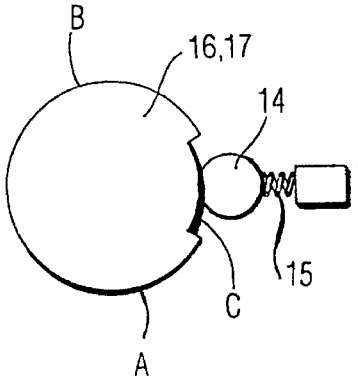

FIG. 5*c* is a diagram of one of the cams which controls the forward or reverse travel or rotational condition of the robot, in a condition wherein the spring biased bearing is in contact with zone C or D.

DESCRIPTION OF THE PREFERRED EMBODIMENT

As shown in the drawings, the robot according to the invention comprises essentially a body 1 in the form of a casing, which has the following associated with it:

a motor unit 2, a propeller turbine 3 for circulation of the water, a housing 4 for a reduction unit which operates a belt drive 5 connected to a roller travel system R, filtering pocket elements 6, and floating elements 7.

According to a fundamental characteristic feature of the present invention all of the aforementioned parts are designed so as to be able to function normally underwater, being substantially unaffected by the moisture for the reasons explained more clearly below.

In fact, with reference first of all to the motor unit 2, the robot according to the invention proposes the use of a low-voltage motor (for example, 12 V), which is of the brushless type and in which the stator and rotor are made perfectly impermeable, such that they are able to function in practice underwater.

Motors in which the stator is insulated by means of a stainless steel capsule are already commercially available, being used for example in the liquid circulating pumps of heating systems. The use of motors of this type in a robot for swimming pools has never been proposed and therefore represents a characteristic feature of the present invention.

Figure 1:
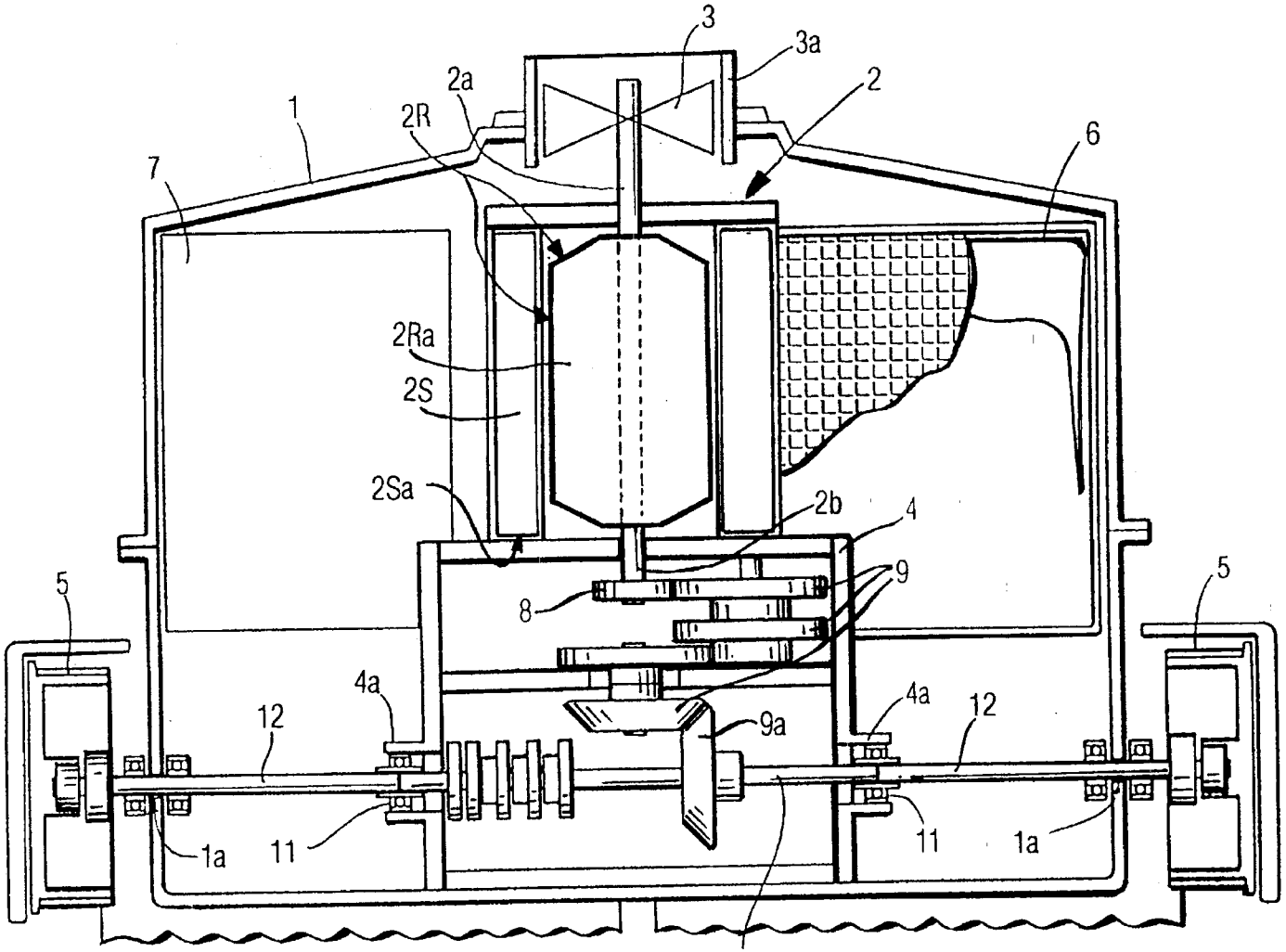
FIG. 1 is a vertical, axial, very schematic cross-section of a preferred embodiment of the apparatus according to the invention.

However, in these motors the steel capsule causes power losses owing to problems associated with both the electrical insulation and magnetic field and therefore requires that the motor itself be designed with larger dimensions, which is not always acceptable. According to the invention, it is therefore preferred to use a motor such as that schematically shown in cross-section in the said FIG. 1, where:

the stator 2S is completely embedded in a protective layer 2Sa of special resin, with a thickness of a few tenths of mm, and the rotor 2R is lined in turn with a film 2Ra of impermeable resin with a thickness of a few hundredths of mm.

According to the present invention, therefore, this type of motor is used by mixing it onto the housing 4 without any protection and the water is able to pass freely through it, in particular by flowing along the air gap between stator and rotor. Thus, not only is it possible to dispense with a watertight housing, with a consequent reduction in costs, avoiding at the origin the drawbacks resulting from sealing defects, but it is also possible to achieve automatically perfect cooling of the motor (which, as can be understood, is dampened both on the outside and on the inside), thus avoiding any risk of overheating.

The shaft of the motor 2, integral with the rotor 2R, is made of a metal or a metal alloy resistant to the action of the swimming-pool water in which it is immersed; preferably it will be made of stainless steel. The opposite ends 2*a* and 2*b* of this shaft emerge from the body of the rotor 2R and are mounted rotatably on steel bearings (not shown): the propeller 3 of the water circulating turbine is directly fixed onto the end 2*a*, and the first gear 8 of the series of gears of the reduction unit 4 is keyed onto the end 2*b*, as described in more detail below.

The propeller 3, as well as the tubular body 3*a* of the turbine—the said body being formed at the top of the body 1 of the robot and as one piece with the latter—are made from moulded plastic of the type suitable for withstanding the action of the chlorinated water of the swimming pool.

The shaft of the motor 2, or at least its two ends 2*a* and 2*b*, have a polygonal, for example square cross-section; thus, fixing of the propeller 3 onto the end 2*a*—as well as, on the other side, fixing of the gear 8 onto the end 2*b* of the drive shaft—are achieved by means of simple forcing of a polygonal, for example square, axial hole of the propeller 3 and/or of the gear 8 onto said shaft ends, and hence once again without using any means subject to oxidation.

The gear 8 also, along with the housing 4 and the other gears 9 and 11 of the reduction unit, are made of moulded plastic. The swimming-pool water is therefore able to circulate freely also inside the reduction unit, the housing 4 of which is in turn not equipped with any sealing means.

The drive shaft 2 normally rotates at a sufficiently high speed—for example of the order of 2700–3000 rpm—so as to allow the propeller 3 to perform the intended action of water suction and circulation (which is described below). On the other hand, the main shaft 10 which operates the belts 5 of the robot travel system must rotate at a much lower speed, for example at 30–50 rpm. For this purpose, the reduction unit 4 comprises a first train of gears 9 with a high reduction ratio, the last of which is the conical pinion 9*a*, which is keyed directly onto the shaft 10.

Preferably, both the shaft 10 and the spindles carrying the gears 9, are made of stainless steel and have a polygonal, for example square cross-section: thus, where the gears must be keyed onto the respective shafts, they may be provided in turn with a square axial hole and be mounted onto said shafts simply by means of a light forcing action; otherwise they are mounted on the shafts preferably by means of steel bearings. In this case as well, therefore, no provision is made for means susceptible to oxidation or damage resulting from the presence of water.

The shaft 10, which is the output shaft of the reduction unit, passes through the housing 4 from one side to the other and is in turn mounted rotatably on two bearings 11 which are also preferably made of steel or in any case resistant to the action of the water and are housed in seats 4*a* formed integrally with the wall of the housing 4.

According to an advantageous feature of the invention, the bearings 11 have both the function of supporting the shaft 10 and the function of joining the ends of this shaft to those of the shafts 12 which form an extension thereof. In fact, the external annular body of the bearings 11 is integral with the seat 4*a* of the housing 4, while the internal annular body is formed by a short tubular element with a polygonal, preferably square internal cross-section, inside which the said ends of the shafts 10, 12 engage with a minimum of slack. This slack is such that it allows at least a brief angular oscillation of the shaft 12 with respect to the shaft 10, for the function which is described in more detail below.

Each extension shaft 12 is guided—on the opposite side to the respective bearing 11 and so as to allow said angular oscillation—inside an essentially horizontal window 1*a* formed in the wall of the body 1 (and shown only schematically in the drawing). In this position, a pair of bearings 13 and 14 is mounted on the shaft 12, being arranged respectively on either side of the aforementioned window 1*a*.

While the internal annular body of these bearings rotates integrally with the shaft 12, their external annular body is mounted so as to cooperate with thrusting means 15, on one side, and with a control cam 16, on the other side.

More precisely, the bearing 13 is subjected to the action of a spring 15, which pushes it in the direction of the arrow F, while the bearing 14 rests on a disc-shaped cam 16 (on the right in FIG. 2) or 17 (on the left in FIG. 2), respectively. When the cam 16, 17 rotates, as described in more detail below, it transmits to the bearing 14, in cooperation with the spring 15, movements in the direction F and in the opposite direction, which are obviously followed by the shaft 12 with oscillation through the angle α.

Figure 3:
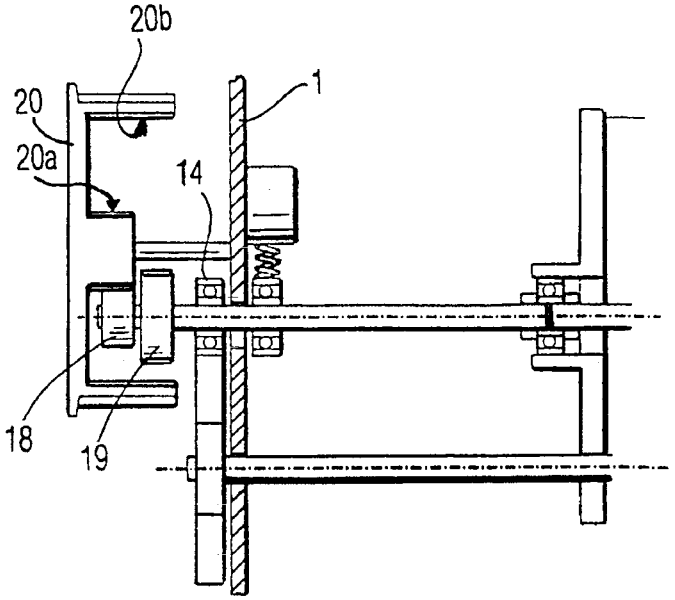
FIG. 3 shows in greater detail, but also schematically, the travel actuating device of the said apparatus in the forward travel condition.
Figure 4:
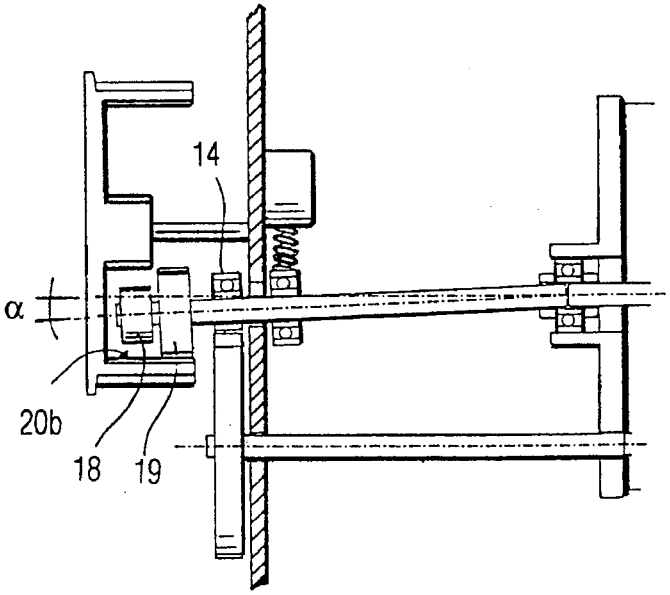
FIG. 4 is a view similar to that of FIG. 3, but in the reverse travel condition.

On the end of the shaft 12 projecting beyond the bearing 14, are keyed two coaxial gears 18 and 19 designed to cooperate with a main drive wheel 20. In fact, the gear 18 is designed to mesh with a pinion 20*a* forming substantially the hub of the wheel 20, and the gear 19 is designed to mesh with a crown gear 20*b* formed inside the peripheral wall of the wheel 20. More precisely, the gear 18 meshes with the pinion 20*a* in one of the two oscillating positions of the shaft 12 (as viewed in FIGS. 2 and 3), in which the gear 19, is however disengaged from the crown gear 20*b*; and on the other hand, the gear 19 meshes with the crown gear 20*b* in the other oscillating position of the shaft 12 (shown in FIG. 4), in which, however, the gear 18 is disengaged from the pinion 20*a*.

As a result of this design, as clearly emerges from an examination of the drawings, when the shaft 10, 12 is caused to rotate, the wheel 20 is rotated in one direction if meshing occurs between the gear 18 and the pinion 20*a*, and in the opposite direction if meshing occurs between the gear 19 and the crown gear 20*b*. The wheel 20 is provided moreover with external teeth 20*c* on which there engages a toothed belt 5 forming a drive transmission to the travel rollers 22. Therefore, according to a fundamental characteristic feature of the invention, the motor 2 may be caused to rotate always in the same direction—and with it both the turbine 3 and shaft 10, 12 rotate in the same direction—while the switching from forward travel to reverse travel or vice versa is obtained via oscillation of the shafts 12.

Figure 2:
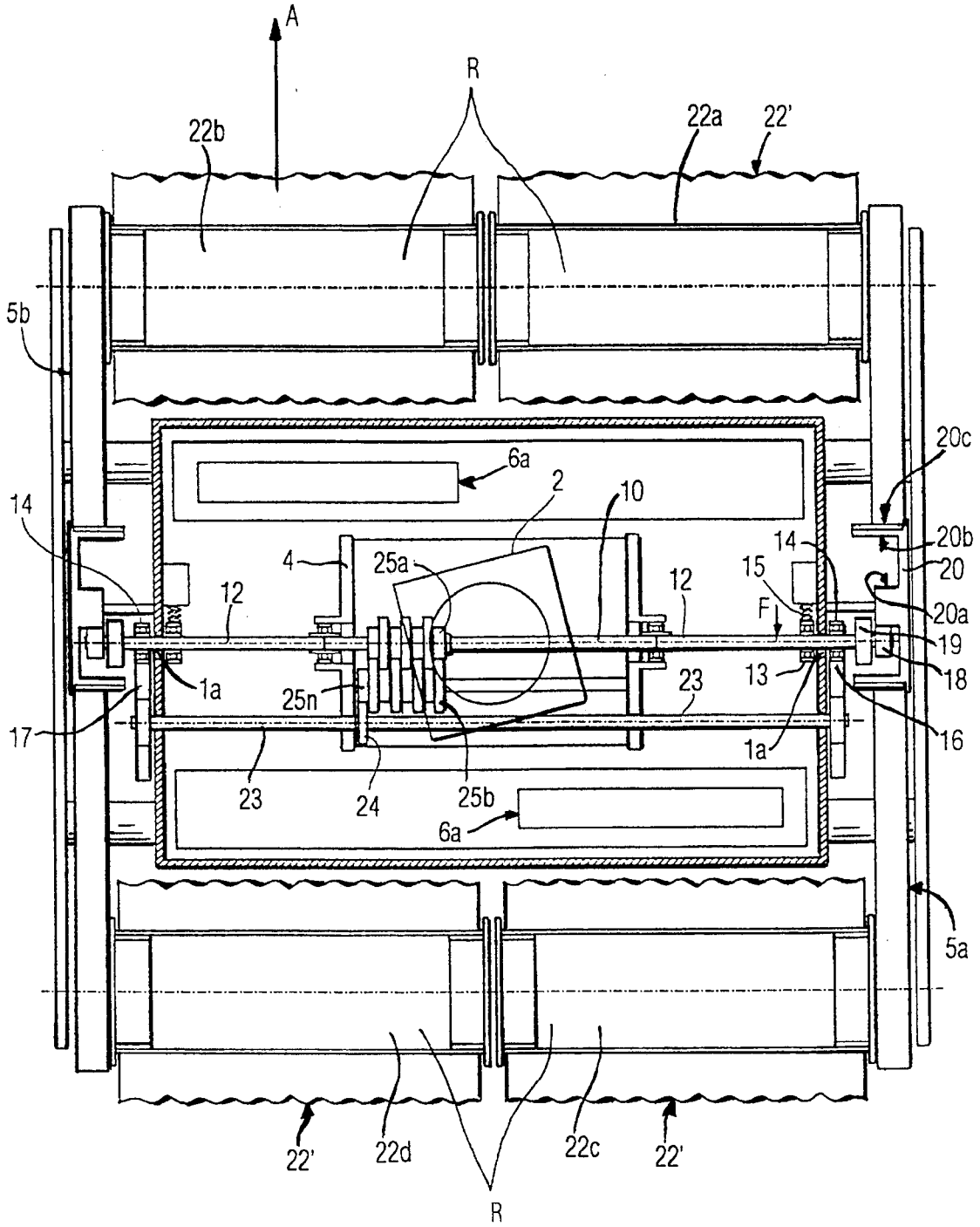
FIG. 2 is a plan view, mainly in schematic cross-section, of the said apparatus.

As can also be seen from FIG. 2, the robot according to the invention is provided with four travel rollers, i.e.:

- two rollers 22*a* and 22*b* mounted freely rotatable, independently of each other, on a common front axis (conventionally defined as such, for the sake of simplicity of the description, with respect to a direction A of travel of the robot), and
- two rollers 22*c* and 22*d* mounted in turn freely rotatable, independently of each other, on a common rear axis (conventionally defined as such, for the same reason stated above);
- the two rollers 22*a* and 22*c* being driven in parallel by the belt 5*a* arranged on the right (with respect to FIG. 2) of the robot, while the two rollers 22*b* and 22*d* are driven by the belt 5*b* on the left of the robot.

Each of the rollers 22 is formed by a rigid body mounted, via self-lubricating bearings (not shown), on the common front or rear axis made of stainless steel. This rigid body has fixed to it the actual roller R which rolls on the surface of the swimming pool and which is preferably formed by a spongy rubber lining designed to rest with friction on the bottom or on the walls of the swimming pool.

The two disc-shaped cams 16 and 17 are keyed onto a common shaft 23 which passes, from one side to the other, through both the box-shaped body 1 of the robot and the housing 4 of the reduction unit. As in the case of the gears 9, these disc-shaped cams are made of plastic and have centrally a polygonal, for example square hole, by means of which they engage with a light forcing action onto the ends—also square—of the steel shaft 23, this engagement being sufficient for keying.

Inside the housing 4, the shaft 23 also has keyed on it a gear wheel 24 meshing with a gear 25*n*, which is the last of a train of gears 25*a*, 25*b*, . . . 25*n*, which receive the movement from the already mentioned shaft 10, so as to cause rotation of the shaft 23 with a high reduction ratio, and obtain for example a speed of rotation of the latter of the order of 0.3 rpm.

The cams 16 and 17 have a profile such as that shown schematically for example in FIGS. 5*a*, 5*b* and 5*c* i.e., with a circular contour having two zones A, B of larger diameter, alternating with two zones C, D of smaller diameter. When the bearing 14, under the thrust of the spring 15, is in contact with one of the zones A or B (FIG. 5*a*), the gear 18 is engaged with the pinion 20*a*, whereas when the bearing 14 is in contact with one of the zones C or D(FIG. 5*c*), it is the gear 19 which is engaged with the crown gear 20*b*. On a same cam 16 or 17, the angular width of the zone A is preferably, but not necessarily, identical to the angular width of the zone B, in the same way that the angular width of the zone C is identical to that of the zone D; however, these widths are different from one cam to another. For example the width of the zones C, D of the cam 16 is greater than the width of the zones C, D of the cam 17, as shown in FIG. 5*b*, for the purpose described in more detail below.

The mode of operation of the robot according to the invention is as follows:

- operation of the motor 2 results firstly in a substantial flow of water through the turbine 3. The water flows into the body 1 of the robot only through the openings 6*a* in its bottom, which communicate with the filtering pockets 6; the water then flows into the pockets 6, where it deposits the dirt which has accumulated in the swimming pool, and flows out from the walls of these pockets so as to flow into the body 1. The water then also flows into the housing 4 and, via the bearings of the shaft 2*a*, 2*b*, also inside the motor 2, in the air gap between stator and rotor, and flows out from the body 1 through the tubular outlet 3*a* at the top;
- operation of the motor 2 also causes rotation of the shaft 10 and of the shaft 23, with the respective reduction ratios, as already mentioned, and the three following travel conditions of the robot may occur:
  - a) assuming that both bearings 14 are in contact with the zones A or B of the respective cams 16 and 17, then both gears 18 are engaged with the pinions 20*a*, so as to cause rotation of the wheels 20, and thus of the drive belts 5*a* and 5*b*, in the direction of forward travel of the robot (direction A);
  - b) assuming, instead, that both bearings 14 are in contact with the zones C or D of the respective cams 16 and 17, then the gears 19 will be engaged with the crown gears 20*b*, so as to cause rotation of the wheels 20, and thus of the drive belts 5*a* and 5*b*, in the direction of reverse travel of the robot (opposite direction to A);
  - c) finally, assuming that the bearings 14 are, on one of the sides, in contact with the zones A or B of the cam 16 and, on the opposite side, in contact with the zones C or D of the cam 17—or vice versa—then the belt 5*a* will transmit a forward travel movement and the belt 5*b* a reverse travel movement, or vice versa, resulting in the robot performing a turning movement about itself.

If we consider the diagram in FIG. 5 it can be seen that, by appropriately forming and combining the disc-shaped cams 16 and 17, perfect automatic control of the robot's movements is obtained. Remembering that the shaft 23 rotates at a speed of about 0.3 rpm, i.e. 1 revolution every 32 seconds as mentioned above, so that every sixteenth of a revolution is performed in 2 seconds, operation occurs as follows:

- in position 1, the bearings 14 are both in contact with the zone A and the two drives both perform forward travel;
- at the segment 1 to 2, corresponding to two sixteenths of a revolution and hence 4 seconds, both bearings 14 are in the zone C and hence the belts both perform reverse travel: the robot moves backward for 4 seconds;
- at the segment 2 to 3, corresponding to a sixteenth of a revolution, one bearing 14 is in contact with the zone C of the cam 16 and the other bearing is in contact with the zone B of the cam 17: the robot turns on itself for 2 seconds;
- at the segment 3 to 4, i.e. for five sixteenths of a revolution, both bearings are in contact with zone B: the robot moves forward for 10 seconds;
- at the segment 4 to 5 the two bearings 14 are in contact with the zone D: the robot moves backward for a further 4 seconds;
- at the segment 5 to 6 one bearing is still in contact with the zone D of the cam 17 while the other one is already in contact with the zone A of the cam 16: the robot turns on itself—in the opposite direction to the condition of the segment 2 to 3—for 2 seconds;
- finally, at the segment 6 to 1, the two bearings are in contact with the zone A: the robot moves forward for a further 10 seconds.

With this timing sequence—which may be obviously easily varied during manufacture of the cams 16 and 17 according to the specific applicational requirements—and taking into account the various random factors which depend in particular on the varying degree of travel resistance and friction which the robot encounters over its travel path, it has been ascertained that the robot is able to cover the entire area to be cleaned.

Furthermore, when the robot reaches a vertical wall of the swimming pool, the latter being connected by a curved portion to the bottom surface, it is able to climb up along this surface. During this substantially vertical movement, the robot—aided in its climbing movement by the upward thrust exerted by the floating elements 7—is constantly moved forward by the rollers 22-R, which grip onto the wall under the thrust resulting from the reaction of the water which is expelled with force from the body 1 by the turbine 3.

It is anyhow understood that the invention is not confined to the particular embodiment illustrated above, which represents only a non-limiting example of its scope, but that numerous variants are possible, all being within reach of a person skilled in the art, without thereby departing from the scope of the invention itself.

What is claimed is:

1. A self-propelled, underwater, electromechanical apparatus for cleaning a bottom and walls of swimming pools, comprising

- an apparatus body provided with a water suction opening and a water outlet,
- a single electric motor unit in said body,
- a circulating turbine connected to said electric motor for circulating water from said water suction opening to said water outlet through a filter system and,
- a mechanical driving unit connected to said electric motor and,
- a roller travel system connected to said driving unit, said driving unit transmitting forward, backward and rotational movement to said roller travel system, wherein at least one of said electric motor and said driving unit has an open structure exposed to the swimming-pool water.

2. Apparatus according to claim 1, wherein the rotor of said electric motor is mounted on a through drive shaft, two opposite ends of which, emerging from the body of the motor, respectively operate said circulating turbine and said driving unit.

3. Apparatus according to claim 2, wherein said through drive drive shaft is made of stainless steel.

4. Apparatus according to claim 3, wherein said shafts have, at least partly, a polygonal cross-section, and the propeller of said circulating turbine and at least some of propeller of said circulating turbine and at least some of said gears have a hole with an identical cross-section, for keying onto said shafts by being simply mounted with a slight forcing action.

5. Apparatus according to claim 2, wherein said circulating turbine is formed by a propeller enclosed in a tube and directly keyed onto through drive shaft, the propeller and tube body of the turbine being made of plastic.

6. Apparatus according to claim 1, wherein said driving unit comprises a reduction unit with an output shaft having two opposite ends for operating two roller travel systems mounted on opposite sides of the body of the apparatus.

7. Apparatus according to claim 6, wherein movement reversal means are arranged between said output shaft and said two roller travel systems.

8. Apparatus according to claim 7, wherein said output shaft is formed by a substantially rigid central section, to which there are hingeably joined two extension sections which have an end locked in rotation with the central section, and another end being able to oscillate between two different working positions, each extension section carrying at its other end at least one gear, which forms said movement reversal means due to its engagement with a forward travel pinion or respectively a reverse travel crown gear in one or respectively the other of said two oscillating positions.

9. Apparatus according to claim 8, wherein each of said two extension shafts has, keyed on its respective end, two coaxial gears, a first gear meshing with said forward travel pinion in a first oscillating position, and a second gear meshing with said reverse travel crown gear in a second oscillating position.

10. Apparatus according to claim 9, wherein said forward travel pinion forms hub of a drive wheel and said reverse travel crown gear is formed inside a cylindrical, peripheral wall of said drive wheel, outside this cylindrical wall there being formed teeth for driving a toothed belt of the driving unit.

11. Apparatus according to claim 10, wherein an oscillating end of each of said extension shafts cooperates with a control cam, so as to be displaced towards one or other of said two oscillating positions.

12. Apparatus according to claim 11, wherein the two control cams associated respectively with each of said extension shafts are keyed onto a common control shaft.

13. Apparatus according to claim 12, wherein said control shaft of said two cams receives the movement from the drive shaft of said single electric motor via a second reduction unit with a high reduction ratio.

14. Apparatus according to claim 12, wherein said control cams have identical and angularly offset profiles or respectively different profiles, so as to cause oscillation of said extension shafts in a staggered time sequence.

15. Apparatus according to claim 10, wherein each of said two roller travel systems comprises a pair of rollers, a front one and a rear one, driven in parallel by one of said toothed belts.

16. Apparatus according to claim 15, wherein the two front rollers of each of the two travel systems are mounted, in a freely and independently rotatable manner, on a common front support shaft, the two rear rollers being mounted likewise on a common rear shaft.

17. Apparatus according to claim 1, wherein said motor is a low voltage motor rotating at a speed ranging from about 2700 to about 3000 rpm.

18. Apparatus according to claim 1, wherein said driving unit comprises a first reduction unit formed by a housing with an essentially open structure and by a train of gears with a high reduction ratio, the individual gears being made of plastic and partly keyed and partly rotatably mounted on stainless-steel shafts, the first gear being directly keyed onto the drive shaft of the electric motor.

19. Apparatus according to claim 18, wherein said train of gears forms a reduction ratio of the order of 60:1 to 100:1, the speed of the output shaft of said first reduction unit being of the order of 30 to 50 rpm.

20. Apparatus according to claim 1, wherein said electric motor is of a brushless type, an electric winding of a rotor and stator of said electric motor being embedded in an impermeable resin, a water passage being formed in a gap between said stator and said rotor.

* * * * *